US005682775A

United States Patent [19]

Baber

[11] Patent Number: 5,682,775

[45] Date of Patent: Nov. 4, 1997

[54] LOCK

[75] Inventor: Murray James Baber, Auckland, New Zealand

[73] Assignee: M J Baber and Company Limited, Auckland, New Zealand

[21] Appl. No.: 573,638

[22] Filed: Dec. 18, 1995

[30] Foreign Application Priority Data

Dec. 19, 1994 [NZ] New Zealand ..... 270197

[51] Int. Cl.[6] ..... E05B 67/36

[52] U.S. Cl. ..... 70/34; 70/39; 70/99; 70/386

[58] Field of Search ..... 70/33, 34, 99, 70/100, 233, 39, 386, 32, 90, 95, 389

[56] References Cited

U.S. PATENT DOCUMENTS

| | | | |
|---|---|---|---|
| 1,453,139 | 4/1923 | Huston | 70/34 |
| 1,511,057 | 10/1924 | Freysinger | 70/39 |
| 2,104,981 | 1/1938 | Falk | 70/33 |
| 3,811,302 | 5/1974 | Sorensen | 70/100 |
| 3,869,887 | 3/1975 | Zeit | 70/100 |
| 4,183,235 | 1/1980 | Coralli et al. | 70/34 |
| 4,229,955 | 10/1980 | Coralli et al. | 70/33 X |
| 4,639,022 | 1/1987 | Dunphy et al. | 70/100 X |
| 4,724,690 | 2/1988 | Dunphy et al. | 70/100 X |
| 4,773,239 | 9/1988 | Lowe et al. | 70/39 X |
| 4,861,079 | 8/1989 | De Forrest, Sr. | 70/DIG. 57 X |
| 5,163,308 | 11/1992 | Lillo | 70/100 X |
| 5,442,941 | 8/1995 | Kähönen et al. | 70/33 X |

FOREIGN PATENT DOCUMENTS

| | | | |
|---|---|---|---|
| 417571 | 1/1947 | Italy | 70/33 |
| 442788 | 11/1948 | Italy | 70/33 |
| 199033 | 5/1984 | New Zealand . | |
| 208255 | 8/1984 | New Zealand . | |

*Primary Examiner*—Lloyd A. Gall

*Attorney, Agent, or Firm*—Oblon, Spivak, McClelland, Maier & Neustadt, P.C.

[57] ABSTRACT

A lock having a hand-slideable lock-bolt. A lock body has a transverse bore passing therethrough and in which the lock-bolt can be mounted. The lock-bolt is movable between locking and unlocked positions. A retention element located in the lock body but externally operable prevents the lock-bolt when in the unlocked position from being removed from the lock body. By externally manipulating the retention element the lock-bolt can be released for complete removal from the lock body. A key operable lock cylinder is located in the lock body and prevents the retention element from being manipulated to release the lock-bolt for removal unless a key is inserted in the lock cylinder and the lock cylinder is in an unlocked position.

13 Claims, 2 Drawing Sheets

LOCK

BACKGROUND OF THE INVENTION

1. Discussion of the Background

This invention relates to a lock and more particularly a lock which has a hand-slideable lock bolt. Such a lock has particular but not exclusive application to the locking of sliding windows, doors and like closures.

2. Description of the Related Art

Locks of this type are typically used for both windows and doors. Consequently it is usual for the lock to be supplied with two lock-bolts of different lengths. The lock-bolt must therefore be completely removable from the housing of the lock so that the lock-bolts are interchangeable.

As a consequence of the lock-bolt being removable it is not unusual for the lock-bolt to either become lost or be misplaced. For example, the fascination of a lock to children can often result in a child removing the lock-bolt and then either losing or hiding the lock-bolt with the result that the absence of the lock-bolt renders the lock ineffective.

Examples of locks of this type can be found in New Zealand patent specifications 217287, 210334 and 199033 of Ogden Industries Pty Ltd and New Zealand patent specification 208255 of Interlock Industries Limited.

SUMMARY OF THE INVENTION

It is an object of the present invention to provide a lock having a hand-slideable lock-bolt having such a construction that a specific procedure is required to remove the lock-bolt even when the lock is in an unlocked position.

Broadly, the present invention comprises a lock having a hand-slideable lock-bolt comprising a lock body and a transverse bore passing therethrough in which the lock-bolt can be mounted, said lock-bolt being moveable between locking and unlocked positions, the lock being characterized by including retention means which prevents the lock-bolt when in the unlocked position being removed from the housing but being adapted to be manipulated such as to release the lock-bolt for complete removal from the lock body.

In the preferred form of the invention the lock includes a key operable lock cylinder, the construction and arrangement being such that the retaining means cannot be manipulated to release the lock-bolt unless the key is inserted in the lock cylinder when said lock cylinder is in an unlocked position.

Various other objects, features and attendant advantages of the present invention will be more fully appreciated as the same becomes better understood from the following detailed description when considered in connection with the accompanying drawings in which like reference characters designate like or corresponding parts throughout the several views and wherein:

DESCRIPTION OF THE PREFERRED EMBODIMENTS

Figure 4:
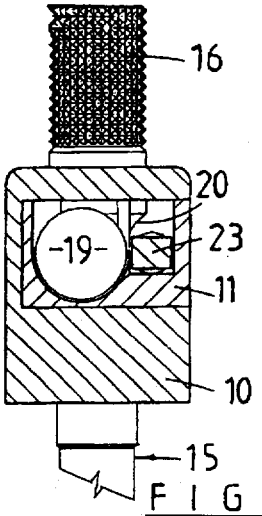
FIG. 4 is a vertical cross section of the lock taken on line 4—4.
Figure 3:
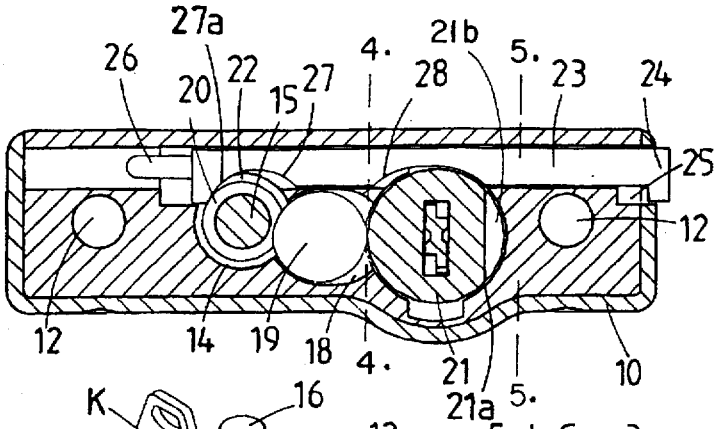
FIG. 3 is a horizontal cross section of the lock.
Figure 1:
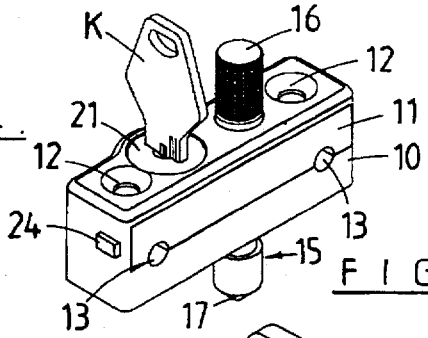
FIG. 1 is a perspective view of a lock with hand-slideable bolt which incorporates the present invention.
Figure 5:
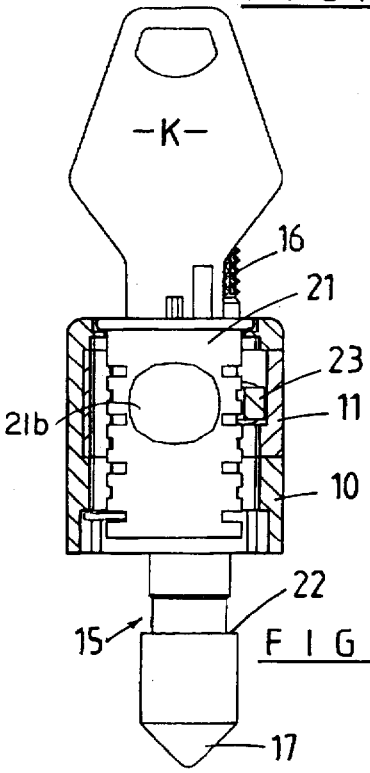
FIG. 5 is a further vertical cross section view of the lock taken on line 5—5.
Figure 2:
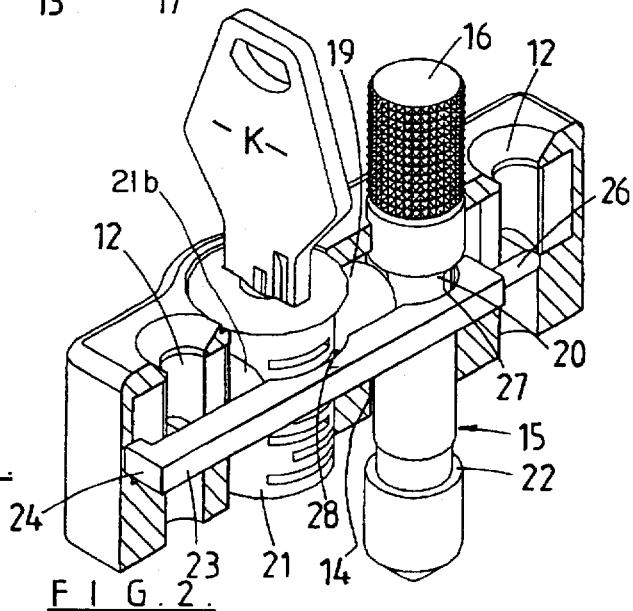
FIG. 2 is a cut-away perspective view of the lock shown in FIG. 1.

The lock comprises in a first embodiment a housing 10 into which a chassis 11 is engaged. Means for locking the chassis into the housing to prevent ready removal thereof is provided.

Extending through housing 10 and chassis 11 are two pairs of bores 12 and 13 through which mechanical fasteners can be inserted to mount the lock with a structure such as the frame or surroundings of a sliding door or sliding window. By incorporating two pairs of bores 12, 13 in planes at mutual right angles the lock can be mounted in two different orientations.

Also extending through housing 10 and chassis 11 are aligned openings which form a bore 14 into which a lock-bolt 15 can be inserted. One end of lock-bolt 15 is provided with a finger grippable portion 16 while the other or leading end 17 is preferably of a conical configuration. In use this leading end 17 engages in a conventional fashion within an opening in the window sash/door so as to lock the window/door against movement relative to its surround or frame.

Engaged in an internal cavity 18 is a spherical member 19 which in turn engages with a waisted portion 20 of the lock-bolt 15. The spherical member 19 is forced into engagement with the waisted portion 20 by the pressure of the peripheral surface of the lock cylinder 21 acting against spherical member 19. The lock cylinder 21 is engaged in a chamber **21*a* formed within the housing 10 and chassis 11**.

By rotating cylinder 21 with a key K, a cavity **21*b* in the cylinder can be aligned with the spherical member 19 to enable it to move in cavity 18 away from lock-bolt 15 when a withdrawal force to lock-bolt 15 is applied via grippable portion 16. Complete removal of the lock-bolt 15 is, however, prevented because shoulder 22 adjacent the leading end 17 of the lock-bolt comes into engagement with a retention bar 23**.

The retention bar 23 extends longitudinally within the chassis 11 though a substantially L-shaped end 24 engages with an opening 25 in the housing 10. The opposite end of the retention bar 23 is engaged with a spring biasing element 26.

The retention bar 23 has a pair of arcuate cut-outs 27 and 28 in its length. The first cut-out 27 is located in the vicinity of lock-bolt 15 and it is a portion **27*a* of this cut-out which engages with the shoulder 22 to prevent removal of the lock-bolt 15. The second cut-out 28 locates in the vicinity of the lock cylinder 21**.

In order to further describe the invention, reference will be made to the operation of the lock. Assuming that the lock is mounted to, say, the frame of a sliding window, the window can be locked against opening by bolt 15 engaged in an opening in the window sash. With the lock 21 in the locked position and the key K removed it is not possible to withdraw the lock-bolt 15 so as to permit the window to be opened.

By inserting the key K and moving the lock 21 to the unlocked position sufficient movement of spherical member 19 is possible (as described above) to permit the lock-bolt 15 to be withdrawn. However, complete removal is not possible due to shoulder 22 coming into engagement with the retention bar 23.

By applying a longitudinal pushing force to end 24 of the retention bar 23 the retention bar can be moved against the bias of spring bias element 26 so that cut-out 27 is substantially coaxial with lock-bolt 15. As the radius of cut-out 27 is slightly greater than the greatest radius of shoulder 22 the lock-bolt 15 can now be completely withdrawn from housing 10. Such movement of the retention bar 23 is possible due to the withdrawal of the lock wafers which would otherwise engage with the surface of cut-out 28 so as to prevent axial movement of the retention bar 23.

If after unlocking the lock cylinder 21 the key K is withdrawn, the lock cylinder wafers once again extend and become located in recess 28 with the retention bar 23 thereby preventing axial movement of the retention bar 23 from taking place. Thus even though lock 21 is in the unlocked position movement of the retention bar 23 is prevented consequently total withdrawal of the lock-bolt 15 is prevented.

The present invention thus provides a lock having a lock-bolt whereby even when the key operable lock is in the unlocked position the lock-bolt 15 cannot be removed unless the key is actually located within the lock. Therefore unless the person using the lock has the key and inserts the same in the lock cylinder, it is not possible to fully withdraw the lock-bolt 15.

Figure 6:
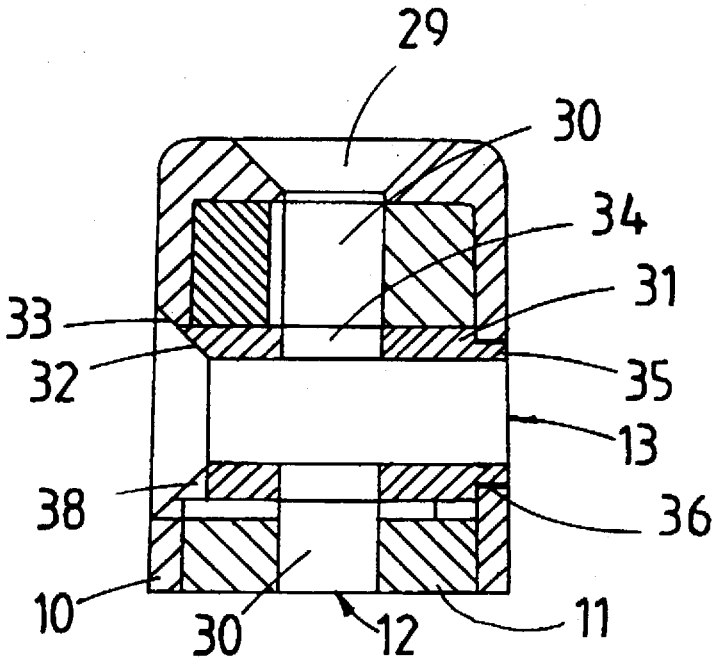
FIG. 6 is a cross sectional view of a second embodiment of the lock housing.
Figure 7:
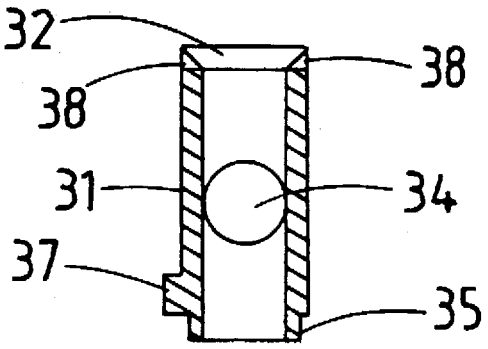
FIG. 7 is a cross sectional view of a locking pin used in conjunction with the arrangement shown in FIG. 6.

Referring to FIGS. 6 and 7 of the drawings, a second embodiment of outer housing 10 and chassis 11 is shown together with a means of locking the two components together. As illustrated in FIG. 6 the lock housing 10 in this embodiment fully engages over the chassis 11. In such a position an opening 29 (of countersunk form) is aligned with passages 30 in the chassis 11 so as to form bore 12.

Bore 13 is formed by a tubular insert 31 which has an internally chamfered end 32 aligning with an inclined portion of opening 33 in housing 10. Openings 34 are formed in the walls of insert 31 and align with passages 30 to form part of bore 12.

The other end of insert 31 is stepped at 35, this step fitting within an opening 36 in the wall of housing 10.

As shown in FIG. 7 a lug 37 extends radially outwardly from the outer wall surface of insert 31 adjacent the step portion 35.

To assemble the lock the chassis 11 is fitted within housing 10 and insert 31 is inserted until step portion 35 engages with opening 36. A screwdriver blade or other like implement can then be inserted into slots 38 in end 32 so that the insert 31 can be rotated. This causes lug 37 to engage into a similarly shaped recess (not shown) in chassis 11. Thus the insertion of insert 31 locks chassis 11 into housing 10 while the locking action achieved by rotation of the insert 31 locks the insert into the chassis 11.

What is claimed is:

1. A lock having a hand-slidable lock-bolt, comprising:

a lock body, a transverse bore passing through the lock body, said lock-bolt being locatable in the bore and slidingly movable between locking and unlocked positions, a lock cylinder operable by a key, said lock cylinder when in a locked position acting on the lock-bolt to retain the lock-bolt in said locking position, said lock-bolt being permitted to be moved to said unlocked position when said lock cylinder is in an unlocked position, the lock including a retention element preventing the lock-bolt from being removed from the bore, the lock cylinder acting upon the retention element preventing operation thereof and preventing the lock-bolt from being removed from the bore unless the lock cylinder is in an unlocked position and the key is located in the lock cylinder the retention element having a portion extendable externally of the lock body for manual actuation thereof, to allow removal of the lock-bolt.

2. A lock as claimed in claim 1 wherein the retention element includes an engagement portion which is engageable with the lock-bolt to prevent the lock-bolt from being removed from the transverse bore.

3. A lock as claimed in claim 2 wherein the lock-bolt includes a shoulder with which said engagement portion is engageable.

4. A lock as claimed in claim 2 wherein the retention element is movable against a biasing member to move said engagement portion clear of the lock-bolt.

5. A lock as claimed in claim 4 wherein a lock-bolt locking element is located within the lock body and engageable with a receiving portion of the lock-bolt, said locking element being forcible by said lock cylinder into the receiving portion to retain the lock-bolt in said locking position.

6. A lock as claimed in claim 4 wherein the retention element is movable along a line of movement transverse to a longitudinal axis of the lock-bolt.

7. A lock as claimed in claim 6 wherein the retention element comprises an elongate element, one end of which is accessible from externally of the lock body, said elongate element including a cut-out portion which when said elongate element is moved against the biasing member is located in a position relative to the transverse bore to permit the lock-bolt to be removed therefrom.

8. A lock having a key operable lock cylinder and a hand-slidable lock-bolt comprising:

a lock body in which said key operable lock cylinder is located, a transverse bore passing through the lock body and into which the lock-bolt is mountable, said lock-bolt being locatable in a locking position and retained in such position by the lock cylinder and movable to an unlocked position upon key operation of the lock cylinder to an unlocking position, the lock including a retention element acted upon by the lock cylinder which prevents the lock-bolt when in said unlocked position from being removed from the lock body, retention element having a portion extendable externally of the lock body for manual actuation thereof, said lock cylinder interacting with the retention element such that when the key is stored in the lock cylinder and said lock cylinder is in the unlocking position, the retention element is permitted to be manipulated from externally of the lock body to release the lock-bolt for complete removal of the lock-bolt from the lock body.

9. A lock as claimed in claim 8 wherein the retention element includes a recess into which lock wafers of the lock cylinder engage when the key is withdrawn from the lock cylinder.

10. A lock as claimed in claim 8 wherein the lock body has two pair of bores extending therethrough and in which one pair of bores for fastening the lock body to a structure can be engaged, one pair of bores being in a plane at right angles to the other pair.

11. A lock as claimed in claim 10 wherein the lock body comprises a housing and a chassis located therein.

12. A lock as claimed in claim 11 wherein each of one said pair of bores is formed by an insert engaged in aligned openings in said housing and chassis, said inserts retaining said housing and chassis together.

13. A lock as claimed in claim 12 wherein each insert including a locking mechanism locking the insert in place in the lock body.

* * * * *